US005751895A

United States Patent [19]

Bridges

[11] Patent Number: 5,751,895

[45] Date of Patent: May 12, 1998

[54] SELECTIVE EXCITATION OF HEATING ELECTRODES FOR OIL WELLS

[75] Inventor: Jack E. Bridges, Park Ridge, Ill.

[73] Assignee: EOR International, Inc., Calgary, Canada

[21] Appl. No.: 600,526

[22] Filed: Feb. 13, 1996

[51] Int. Cl.[6] ..... E21B 36/04

[52] U.S. Cl. ..... 392/306

[58] Field of Search ..... 392/301, 303, 392/305, 306; 166/60, 302

[56] References Cited

U.S. PATENT DOCUMENTS

| | | | |
|---|---|---|---|
| 4,524,827 | 6/1985 | Bridges et al. | 166/248 |
| 4,793,409 | 12/1988 | Bridges et al. | 166/57 |
| 4,821,798 | 4/1989 | Bridges et al. | 166/60 |
| 4,919,201 | 4/1990 | Bridges et al. | 166/60 |
| 5,012,868 | 5/1991 | Bridges | 166/248 |
| 5,070,533 | 12/1991 | Bridges et al. | 392/301 |
| 5,099,918 | 3/1992 | Bridges et al. | 166/60 |
| 5,420,402 | 5/1995 | Bridges et al. | 219/772 |
| 5,539,853 | 7/1996 | Jamaluddin et al. | 392/302 |
| 5,621,844 | 4/1997 | Bridges | 392/301 |
| 5,621,845 | 4/1997 | Bridges et al. | 392/303 |
| 5,623,576 | 4/1997 | Deans | 392/303 |
| 5,632,604 | 5/1997 | Poothodiyil | 417/225 |

*Primary Examiner*—Adolf Berhane

*Attorney, Agent, or Firm*—Dorn, McEachran, Jambor & Keating

[57] ABSTRACT

A control for an electrical heating system that enhances production from an oil well, particularly a horizontal oil well; the well includes an initial well bore extending downwardly from the surface of the earth through one or more overburden formations and into communication with a producing well bore that extends or deviates outwardly from the initial well bore into an oil producing formation. The heating system includes an array of short, electrically conductive heating electrodes extending longitudinally through the producing well bore. The heating system further includes apparatus for electrically energizing electrodes that are close to each other with A.C. power; the A.C. power supplied to electrodes near each other has a phase displacement of at least 90°, usually 120° or 180°, between electrodes. The control Includes plural power switches, each connected to at least one heating electrode; each power switch is conductive only up to a predetermined limit (usually a temperature limit). In one embodiment, each power switch includes a sensor responsive to the operating condition of its heating electrode. Another embodiment employs a telemeter circuit to actuate the power switches with sensors that are separate from the power switches.

10 Claims, 4 Drawing Sheets

SELECTIVE EXCITATION OF HEATING ELECTRODES FOR OIL WELLS

BACKGROUND OF THE INVENTION

Major problems exist in producing oil from heavy oil reservoirs due to the high viscosity of the oil. Because of this high viscosity, a high pressure gradient builds up around the well bore, often utilizing almost two-thirds of the reservoir pressure in the immediate vicinity of the well bore. Furthermore, as the heavy oils progress inwardly to the well bore, gas in solution evolves more rapidly into the well bore. Since gas dissolved in oil reduces its viscosity, this further increases the viscosity of the oil in the immediate vicinity of the well bore. Such viscosity effects, especially near the well bore, impede production; the resulting waste of reservoir pressure can reduce the overall primary recovery from such reservoirs.

Similarly, in light oil deposits, dissolved paraffin in the oil tends to accumulate around the well bore, particularly in electrode screens and perforations to admit oil into the well and in the oil deposit within a few feet of the well bore. This precipitation effect is also caused by the evolution of gases and volatiles as the oil progresses into the vicinity of the well bore, thereby decreasing the solubility of paraffins and causing them to precipitate. Further, the evolution of gases causes an auto-refrigeration effect which reduces the temperature, thereby decreasing solubility of the paraffins. Similar to paraffin, other condensable constituents may also plug up, coagulate or precipitate near the well bore. These constituents may include gas hydrates, asphaltenes and sulfur. In certain gas wells, liquid distillates can accumulate in the immediate vicinity of the well bore, which also reduces the relative permeability and causes a similar impediment to flow. In such cases, accumulations near the well bore reduce the production rate and reduce the ultimate primary recovery.

Electrical resistance heating has been employed to heat the reservoir in the immediate vicinity of a well bore. Basic systems are described in Bridges U.S. Pat. No. 4,524,827 and in Bridges et al. U.S. Pat. No. 4,821,798. Tests employing systems similar to those described in the aforementioned patents have demonstrated flow increases in the range of 200% to 400%.

Various proposals over the years have been made to use electrical energy for oil well heating, in a power frequency band (e.g. DC to 60 Hz AC), in the short wave band (100 kHz to 100 MHz), or in the microwave band (900 MHz to 10 GHz). Various down-hole electrical heat applicators have been suggested; these may be classified as monopoles, dipoles, or antenna arrays. A monopole is defined as a vertical electrode whose length is somewhat smaller than the depth of the deposit; the return electrode, usually of large diameter, is often located at a distance remote from the deposit. For a dipole, two vertical, closely spaced electrodes are used and the combined extent is smaller than the depth of the deposit. These dipole electrodes are excited with a voltage applied to one relative to the other.

In the past, radio-frequency (RF) dipoles have been used to heat earth formations. These RF dipoles were based on designs used for the radiation or reception of electromagnetic energy in the radio frequency or microwave spectrum. In an oil well an RF dipole is usually in the form of a pair of long, axially oriented, cylindrical conductors. The spacing between these conductors is generally quite close at the point where the voltage is applied to excite such antennas. The use of such vertical dipoles has been described, as in Bridges et al. U.S. Pat. No. 4,524,827, to heat portions of the earth formations above the vaporization point of water by dielectric absorption of short-wave band energy. However, such arrangements have been found to be costly and inefficient in heating moist earth formations, such as heavy oil deposits, because of the cost and inefficiency of the associated short-wavelength generators and because such short wavelengths do not penetrate moist deposits as well as the long wavelengths associated with power-frequency resistive heating systems. Further, if an RF dipole is used to heat moist deposits by resistance heating the heating pattern is inefficient because the close spacing of the cylindrical conductors at the feed point creates intense electric fields. Such high field intensities create hot spots that waste energy and that cause breakdown of the electrical insulation.

Where heating above the vaporization point of water is not needed, use of frequencies significantly above the power frequency band is not advisable. Most typical deposits are moist and rather highly conductive; high conductivity increases losses in the deposits and restricts the depth of penetration for frequencies significantly above the power frequency band. Furthermore, use of frequencies above the power frequency band may require the use of expensive radio frequency power sources and coaxial cable or waveguide power delivery systems.

Bridges et al. U.S. Pat. No. 5,070,533 describes a power delivery system which utilizes an armored cable to deliver AC power (2–60 Hz) from the surface to an exposed vertical monopole electrode. In this case, an armored cable of the kind commonly used to supply three-phase power to down-hole pump motors is employed. However, the three phase conductors are conductively tied together and thereby form, in effect, a single conductor. From an above-ground source, the power passes through the wellhead and down this cable to energize an electrode embedded in the pay zone of the deposit. The current then returns to the well casing and flows on the inside surface of the casing back to the generator.

A monopole design, such as disclosed in U.S. Pat. No. 5,070,533, represents the state of the art to install electrical resistance heating in vertical wells. However, the use of electrical heating arrangements for vertical wells introduces major difficulties in horizontal well completions. These difficulties must be addressed to make electrically heated horizontal wells practical and economical.

Drilling technology has advanced to a point where horizontal completions are commonplace. In many cases, the length of a horizontal producing zone can be over several hundred meters. Horizontal completions often result in highly economic oil wells. In some oil fields, however, the results from horizontal completions have sometimes been disappointing. This may occur for some deposits, such as certain heavy oil reservoirs where a near-wellbore, thermally-responsive, flow impediment or skin-effect forms. In such cases, the use of electrical, near-wellbore heating offers the opportunity to suppress the skin effects. This can make otherwise marginal heavy-oil or paraffin-prone oil fields highly profitable. To use electrical heating methods, existing vertical well electrical heating technology must be redesigned and tailored for horizontal completions.

Long horizontal well completions, or even long vertical well installations, that employ near well-bore electrical heating introduce several important problems not adequately resolved by application of the aforementioned vertical well electrical heating technology. The spreading resistance of the electrode (the resistance of the formation in contact with the electrode) is approximately inversely proportional to the length of the heating electrode. Typically, the spreading resistance of an electrode a few meters long in a vertical well is in the order of a few ohms. This electrode is supplied power via a cable or conductor that usually has a resistance of a few tenths of an ohm. In the case of a vertical well, the resistance of the cable, the spreading resistance of the small electrode in the pay zone and the spreading resistance of the casing as the return electrode are all in series. In this case the power dissipated in each resistor is proportional to the value of the resistance. (For a vertical well, the spreading resistance of the casing can be neglected.) For this example, only about ten percent of the power applied at the wellhead would be dissipated in the power delivery cable.

In the case of a long horizontal electrode, however, the spreading resistance may be only a few tenths of an ohm because of the long length of the horizontal electrode. This value can be very small compared to the series resistance of the power delivery conductor. The spreading resistance of the horizontal electrode can be comparable to the spreading resistance of the casing, if the casing functions as the return electrode. Because the spreading resistance of the electrode is comparable to the series resistance of the return electrode and also to the resistance of the cable, only a small fraction of the power delivered to the wellhead will be dissipated in the deposit.

Another problem with applying vertical well electrical heating technology horizontally is the large power requirement implied by the long lengths of possible horizontal wells. For example, a producing zone of six meters depth with a five meter vertical electrode may exhibit an unstimulated flow rate of 100 barrels per day. Typically, the vertical well could be electrically stimulated with about 100 kilowatts (kW) to produce up to about 300 barrels of low-water content oil per day. For this example, the energy requirement at the wellhead would be about eight kilowatt hours (kWh) per barrel of oil collected. Assuming a power delivery efficiency of 85%, and a thermal diffusion loss of 20% from the heated zone to adjacent cooler formations, the power delivered to the deposit to increase the temperature of the nearby formation and ingressing oil to a temperature of 55° C. would be in the order of five kWh per barrel. The power dissipation along the vertical electrode would be about 20 to 25 kilowatts (kW) per meter. This rather high power intensity, 20 kW per meter along the electrode, assures that the formation at least several meters away from the well bore will be heated to a temperature where the viscosity is reduced by at least an order of magnitude, thereby enhancing the production rate. The thermal diffusion of energy to adjacent non-deposit formations is suppressed by the compact shape of the heated zone, which has a low surface area to volume ratio and which experiences a high heating rate.

On the other hand, a single screen/electrode combination in a horizontal completion may be as long as 300 meters. Based on vertical well experience, the unstimulated flow rate could be about 300 barrels per day with the expectation that the electrically stimulated rate would be increased to about 900 barrels per day. About 300 kW at the wellhead would be needed to sustain this stimulated flow, assuming conditions similar to the above vertical well example. Further, assuming that the vertical well technology is applied to a horizontal well completion, the power dissipation along the horizontal electrode would be about one kW per meter as opposed to 20 kW per meter in the deposit for the vertical electrode.

In the above example there is a one kW dissipation per meter in the deposit along the horizontal screen/electrode, as opposed to the 20 kW dissipation per meter for the vertical screen/electrode. This low power intensity along the electrode/screen suggests that the temperature rise in the deposit along the horizontal screen may be much lower than that along the screen of a vertical well. The principal reasons are that the surface area to volume of the heated zone is much larger than that for the vertical well, and the heating rate is too slow, enhancing the heat loss by thermal diffusion to the cooler nearby formations. The heat from this one kW per meter dissipation may be insufficient to raise the temperature of the heated zone to where the viscosity of the oil is reduced enough to afford worthwhile flow increase. This suggests that the well head power requirement per barrel of oil of eight kWh that was based on experience with vertical wells may be too low for a horizontal well with a long uninterrupted electrode.

An additional problem is that the electrical current distribution injected into the deposit from the horizontal electrode may also be highly non-uniform. Similar non-uniform distributions have resulted in hot spots near the tips of vertical electrodes and has necessitated the use of expensive, high performance electrical insulation materials near the electrode tips of vertical wells. Similar hot spots can be expected to occur for horizontal completions, especially if the delivered power is in the order of several hundred kilowatts. Aside from the hot spots, such non-uniform heating along the electrode can result in inefficient use of electrical energy.

Another problem is that of heterogeneity of the horizontal formation through which the horizontal well is completed. If the resistivity of the formation varies along the length of the completion, greater heating rates might occur in regions where the resistivity is low. This could be a serious problem, since the location of the producing zone may not be accurately characterized. For example, if a horizontal well unknowingly is directed into a formation that has a low resistivity, most of the electrical heating power may be dissipated in this low resistivity barren region, thereby creating a hot spot and lowering the overall efficiency.

Additional difficulties may arise in the case of very long horizontal completions, as in completions in excess of a few hundred meters. In these cases, the amount of power required, despite energy conserving methods described in the patent application entitled "Iterated Electrodes for Oil Wells" filed concurrently herewith, may be beyond practical values. In a long horizontal well, even with the iterated electrode arrangement, the electrical power consumption and the resulting stimulated flow rate may be intractable. Further, the electrical heating may preferentially heat portions of the deposit, either wasting energy or causing excessive amounts of water to be produced in such locations. Also, long runs of horizontal electrodes may penetrate several barren formations as well as isolated "pools" or sub sections of reservoirs. The production from some of the "pools" may preferably be electrically enhanced prior to electrically enhancing the production from other "pools".

In the case of vertical wells, where two or more electrodes are emplaced between barren and often low resistivity formations, some of the above problems may also be experienced.

STATEMENT OF THE INVENTION

The overall object of this invention is to control the excitation of two or more electrodes in a producing zone such that substantial benefits from the electrical stimulation of oil wells can be realized.

Further, a series of two or more short electrodes are deployed in a long borehole that traverses one or more producing zones, such as might be found in a horizontal well, wherein the excitation of these electrodes are controlled to enhance production, increase the utilization of electrical energy, suppress excessive production of water and optimize the overall reservoir recovery.

The electrical excitation of a specific electrode is controlled such that if the temperature of the electrode exceeds a predetermined limit, the electrical excitation is removed or reduced.

The electrical excitation of a specific electrode is further controlled such that if the temperature of the electrode falls below a predetermined limit, the electrical excitation is increased.

The excitation of one or more electrodes is controlled so as to selectively heat preselected portions, strata, or "pools" that occur along a borehole in an oil reservoir.

The excitation of two or more electrodes is controlled to alter the current distribution along the electrodes so as to suppress hot spots.

Apparatus to control the excitation of one or more electrodes that sends signals via the power delivery system, wherein the excitation to each electrode or group of electrodes is controlled by the signals that appear near the connection point between each electrode or group of electrodes and the power delivery system.

Apparatus to sense the physical phenomena near an electrode or group of electrodes, including apparatus to send data that characterizes the physical phenomena to the surface via the power delivery system, and a receiver to receive the signals at the surface and process and display the data at the surface.

Apparatus to control the excitation of an electrode may consist of a temperature sensor near the electrode, a switch to disconnect the electrode in the event its temperature exceeds a predetermined value, and apparatus to reconnect the electrode in the event that its temperature falls below a predetermined value.

Apparatus to control the excitation of one or more electrodes may consist of downhole sensors near the electrodes, apparatus to telemeter data sensed by the sensors to the surface, means to evaluate the downhole data, further apparatus to telemeter control signals from the surface to telemetry receivers near each electrode, and apparatus to vary the power to each electrode in response to the received telemetered signals.

In line with the foregoing objectives, the following specific benefits are noted:

Very long horizontal wells in heterogeneous reservoirs can be practically heated.

The heating of portions of a well can be controlled to selectively heat "pools" so as to increase overall recovery.

The amount of power needed to realize a significant economic benefit from the electrical heating near the borehole can be reduced to economically attractive values by selectively heating portions of a long, electrically stimulated well, particularly a horizontal well.

The capital equipment costs of the above-ground electrical equipment can be made economically attractive by keeping the power requirements within reason.

The resistance presented to the power delivery conductors by the electrode assembly can be increased to realize an acceptable power delivery efficiency with conventional cable or conductor designs by disconnecting some of the electrodes.

The energy lost to adjacent formations by thermal diffusion can be reduced by selectively and rapidly heating groups of nearby electrodes over a period of time and then rapidly heating other similar groups at other times, thereby permitting more effective and efficient use of the applied electrical power.

The temperature rise in formations near the rapidly heated electrodes can be made great enough to make electrical stimulation heating effective.

The heating of selected portions of the oil reservoir can be implemented to suppress excessive production of water or to increase overall recovery from the reservoir.

DETAILED DESCRIPTION OF PREFERRED EMBODIMENTS

Figure 1:
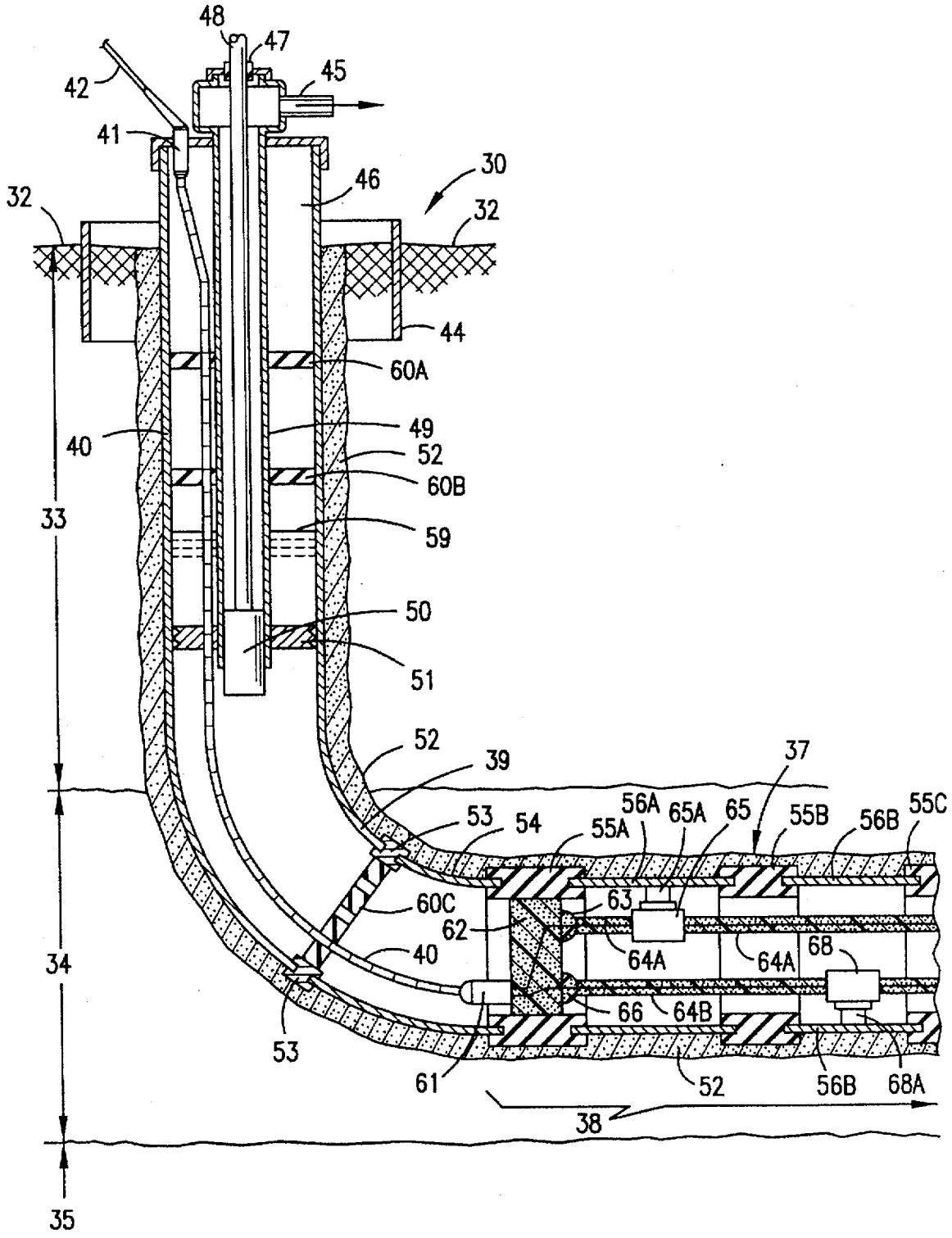
FIG. 1 is a simplified sectional illustration of an oil well showing only the first two electrodes of a multi-electrode array in a horizontal well completion.

The principal application of this invention is for electrical heating of horizontal oil wells. However, the technology described can also be used for vertical wells that are completed through deep continuous reservoirs or through several producing formations that lie between conductive barren zones. The components can be used to telemeter data to the surface concerning downhole temperatures, resistivity of liquids in the borehole, the specific voltage applied to an electrode, the current that flows out from an electrode, or the down-hole pressures that may be encountered near an electrode, such as may be found in a long horizontal completion. Such data can be used to control the heating of the deposits near specific electrodes such that electrical energy is efficiently employed and improved overall recovery of oil in the reservoir is realized.

A single horizontal well can be realized by slowly changing the angle of the borehole from vertical to horizontal on a large radius (e.g., one hundred meters) and guiding the well bore drill to pass horizontally through the main portion of a deposit. Such apparatus typically can exhibit horizontal penetration of the reservoir in the order of one hundred to one thousand meters.

A major problem, if a long horizontal continuous electrode is used, is that the design complexity and power required by the electrically heated well is nearly directly proportional to the length of such an electrode. On the other hand, it can be demonstrated that the increase in flow rate is not proportional to the length of the electrode, but rather to some reduced fraction of the increase.

The much increased surface-to-volume ratio of the heated formations near a long, uninterrupted horizontal electrode is another cause for inefficiency. Such an increase will greatly augment the thermal diffusion losses to adjacent formations relative to those experienced from conventional vertical wells. The low power injected per meter along an uninterrupted horizontal electrode also makes it difficult to increase the temperature of the formations adjacent a long horizontal electrode to a temperature high enough to significantly reduce the viscosity.

For the present invention groups of shorter electrodes, each of which creates a local region of enhanced dissipation and temperature rise, are deployed along the horizontal borehole. Each of these groups could be spaced such that the production zones of influence created by such high temperature regions would not overlap substantially. However, electrode spacing should still be close enough such that the reservoir pressure near the horizontal borehole at any position is maintained at some predetermined value above the pressure within the horizontal screen/electrode. This value should be some fraction of the difference between the shut-in reservoir pressure and the pressure within the horizontal screen/electrode. As demonstrated in the aforementioned patent application entitled "Iterated Electrodes for Oil Wells", such an approach can result in practical designs for horizontal completions in the order of a few hundred meters long and that are emplaced in producing zones with high resistivities.

Such iterated electrode arrays also suppress thermal diffusion heating effects by using a series of short electrodes that are widely spaced along the horizontal screen. The heated volume near each electrode has a surface-to-volume ratio similar to that experienced for conventional short vertical electrodes, thereby suppressing excessive heat losses due to thermal diffusion that might occur for a long uninterrupted electrode. When properly done, this reduces the power requirements, increases the input resistance, and reduces thermal diffusion losses.

One of the difficulties with extending the conventional short electrode vertical well completion technique to horizontal well applications is that the casing is conventionally used as the return electrode. The electrode length can be comparable to the length of the return electrode, the well casing. Thus, the spreading resistance of a barren formation near the casing would dissipate about as much power as the oil-bearing formation near the horizontal electrode, thereby wasting power. This inefficient design for long electrodes is overcome by the use of the iterated electrode design approach.

One solution is illustrated in FIG. 1, where a heating electrode may also serve as a return electrode in the horizontal borehole. For illustrative purposes, only one pair of electrodes are shown in FIG. 1, but additional pairs are usually employed, as shown in FIG. 2.

Figure 2:
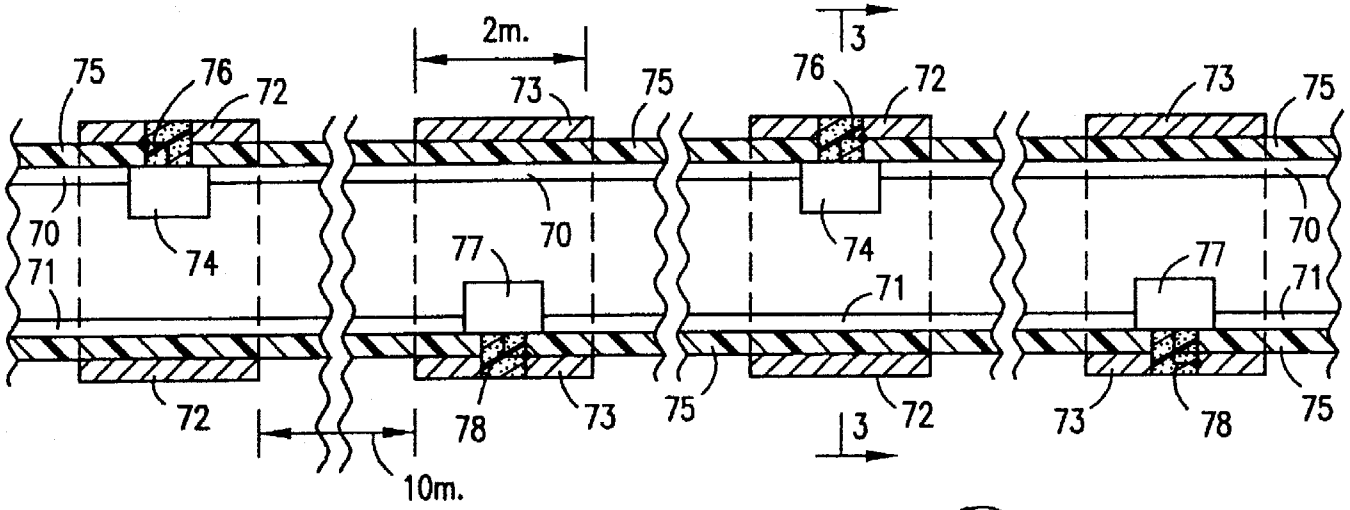
FIG. 2 is simplified illustration, in cross-section, of a section of a horizontal completion, showing a series of iterated electrodes.

Another advantage of using the symmetrical excitation illustrated in FIGS. 1 and 2 is that each electrode pair exhibits about twice as much spreading resistance as for the monopole arrangement used in vertical wells, where each heating electrode in the reservoir is shorter than the return current electrode, such as the well casing. To realize this advantage, the geometry of all heating electrodes should be about the same and the voltage applied to one of the electrodes should be of opposite polarity of that applied to the other electrode of the pair. This can be done simply by not grounding the output terminals of the power source or of the transformer that supplies power to the wellhead. Thus, by using dual excitation, power is more effectively applied to the deposit, power which would otherwise be wasted in a barren formation. Moreover, the power delivery efficiency is improved by increasing the spreading resistance presented to the power delivery system.

While the above techniques, when properly applied, can realize many of the benefits of electrically enhanced oil recovery for horizontal completions, several other difficulties may arise. One arises because oil deposits are seldom homogenous; they are more likely to be heterogenous. Such heterogeneity can result in some electrodes being located in zones that have less resistivity than others. This will result in greater energy dissipation in the zones which have the lower resistivities. Some electrodes may be placed in formations that are less permeable than others. This can cause the electrodes that are located in the low flow rate zone to experience greater temperature rise than those in the high flow rate and more permeable formations. In addition, the length of some horizontal completions may well exceed one thousand meters. Because of this length, heating the entire length of an iterated electrode array may require excessively large amounts of power or may result in power delivery inefficiencies. Therefore, it may be desirable to heat only selected electrodes initially, and then heat the remaining electrodes later on. It may be desirable to heat certain pools first, in order to extend the life of the reservoir. To address these difficulties, a technique for controlling the temperature or power dissipated by individual electrodes is described hereinafter.

FIG. 1 illustrates a well 30 that has been deviated to form a horizontal borehole 37. For illustrative purposes, some dimensions have been greatly foreshortened in FIG. 1. The relative diameters of the casing and screen as illustrated may be different, depending on the depth of the well and the method of installing the screen/electrode assembly. Also, the lengths of the electrodes and intervening fiber reinforced plastic (FRP) screen isolation sections are chosen for easy illustration and may be significantly different for an actual installation. The well 30, FIG. 1, is installed by first drilling a vertical borehole from the earth surface 32 through at least some of the overburden 33. The boring is deviated, in a deeper portion of the well 30, to form the generally horizontal section 37 of the borehole. This horizontal borehole 37 lies in an oil reservoir 34, which is between the overburden 33 and the underburden 35. After the boring tool is removed, a screen/electrode assembly 38 is attached to the casing string and then lowered through the vertical borehole to be inserted into the horizontal borehole 37.

The upper part of the well 30, in the overburden 33, may be identical to the upper portion of the vertical, monopole-type well in FIG. 1 of U.S. Pat. No. 5,070,533 except that the cable 40 and the feed-through connector 41 and cable 42 to the power supply (not shown, but similar to those described in U.S. Pat. No. 5,099,918 for Power Sources for Downhole Electrical Heating) have two conductors. These conductors are insulated one from the other and are supplied with power from an ungrounded two terminal source (or from two terminals of a three terminal source) where one terminal is positive phased with respect to ground and the other terminal is negative phased. Cable 40 within the well may also have a metallic armor. The upper parts of the well 30 include a surface casing 44, a flow line 45 to a product gathering system (not shown), a wellhead chamber 46, a pump rod lubricator or bushing 47, a pump rod 48, a production tubing 49, a pump 50, and a tubing anchor 51. The pump 50 may be located at any depth below the liquid level 59.

The casing string 49 in well 30 has grout 52 down to the packer/hanger 53 that attaches the upper casing to the more horizontal portions of the casing, blank casing spacers 54 and a screen/electrode assembly 38. The outermost portions of the screen/electrode assembly 38 include the blank steel spacer section 54, fiber reinforced plastic (FRP) or other electrical insulator pipe sections 55A, 55B and 55C, the first (positive) electrode 56A and a second (negative) electrode 56B. The heating electrodes 56A and 56B are preferably formed from sections of steel pipe. The polarity designates the positive or negative phased A.C. terminals or connections. Direct current is not used. Both the FRP pipe sections and the electrodes are usually perforated or slotted to admit oil into the interior of the well; the well grouting is ordinarily porous enough for this purpose.

In the vertical portion of well 30 the insulated cable 40 is guided through two or more centralizers such as 60A and 60B; all of the centralizers usually are perforated (perforations not illustrated) to permit liquid flow. There are also flow apertures in the lowermost centralizer 60C. The cable 40 is terminated in a connector assembly 61 that is attached to a dual-wire-cable-to-single-wire-cable insulator distributor block 62, which is also perforated (not shown) for liquid flow. A connector 63 connects one cable conductor to the single conductor in an insulated cable 64A. The conductor in cable 64A is connected to a "T" connector 65 that provides a connection 65A to electrode 56A. The "T" connector 65 may also house a simple switch that will disconnect electrode 56A from the conductor in cable 64A if the temperature of electrode 56A becomes too high. Components 66, 64B, 68 and 68A provide similar functions; electrode 56B is connected to the wire in cable 64B by a "T" connection 68A from connector 68. Connections 65A and 68A are insulated as shown for the "T" connectors 74 and 77 in FIG. 2.

The deposit around the screen/electrode assembly 38 is heated by applying A.C. voltage to the two conductors of cable 42 at the surface 32. This causes A.C. current to flow through cable 40 and thence to the screen/electrode assembly 38. This applies an A.C. voltage between electrodes 56A and 56B, thereby causing current to flow through the reservoir liquids that fill the space between the horizontal borehole and the screen/electrode assembly 38 and portions of the reservoir 34 that are adjacent to the electrodes. One advantage of the arrangement shown in FIG. 1 is that the heating electrodes (e.g., 56A or 56B) are also return electrodes. These electrodes are located in the oil deposit and no power or heat is wasted in barren formations, as might be the case if vertical well technology were routinely applied to the horizontal well 30.

FIG. 2 illustrates the iterated electrode construction in more detail. In this example, two meter long, cylindrical, perforated electrodes 72 and 73 are positioned at ten meter intervals along the horizontal bore. The electrodes 72 and 73 are spaced from each other by means of a perforated or slotted fiber-reinforced plastic pipe (casing) 75. By applying oppositely polarized potentials between adjacent electrodes, currents are injected into the reservoir that will heat the oil-bearing formation near the electrodes. As shown, the positively phased electrodes 72 are each connected to the positively phased conductor in the insulated cable 70 via the conductors 76 in a series of insulated "T" connectors 74. The negatively phased electrodes 73 are each connected to the negatively phased conductor in an insulated cable 71 via the conductors 78 in a series of insulated "T" connectors 77. The perforations in members 72,73, and 75 are not illustrated.

Figure 3:
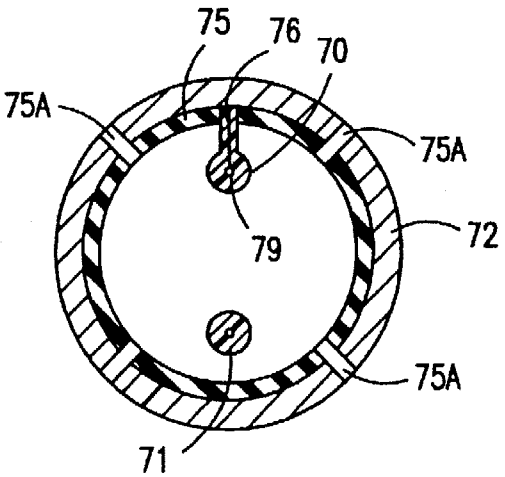
FIG. 3 is a cross-section, on an enlarged scale, taken approximately on line 3—3 in FIG. 2.

FIG. 3 shows a cross section of the screen/electrode assembly taken approximately along line 3—3 in FIG. 2. FIG. 3 includes some of the perforations or slots 75A that are needed to permit fluids to enter the well bore. Perforations 75A should be small enough to prevent sand particles from entering with the oil. The conductor 79 in cable 70 is covered with insulating material and provides a conductive connection between the conductor in the insulated cable 70 and the electrode 72.

While the described iterated electrode arrangement permits efficient power delivery, at the same time realizing substantial stimulation of the flow rate for many horizontal well completions, other conditions or effects may occur that require control of individual electrodes or groups of electrodes. Such conditions may occur for longer horizontal completions, where the horizontal borehole penetrates formations with different resistivities or flow rates, or where some portions of the formations penetrated by the horizontal completion should be produced before other portions.

Figure 4:
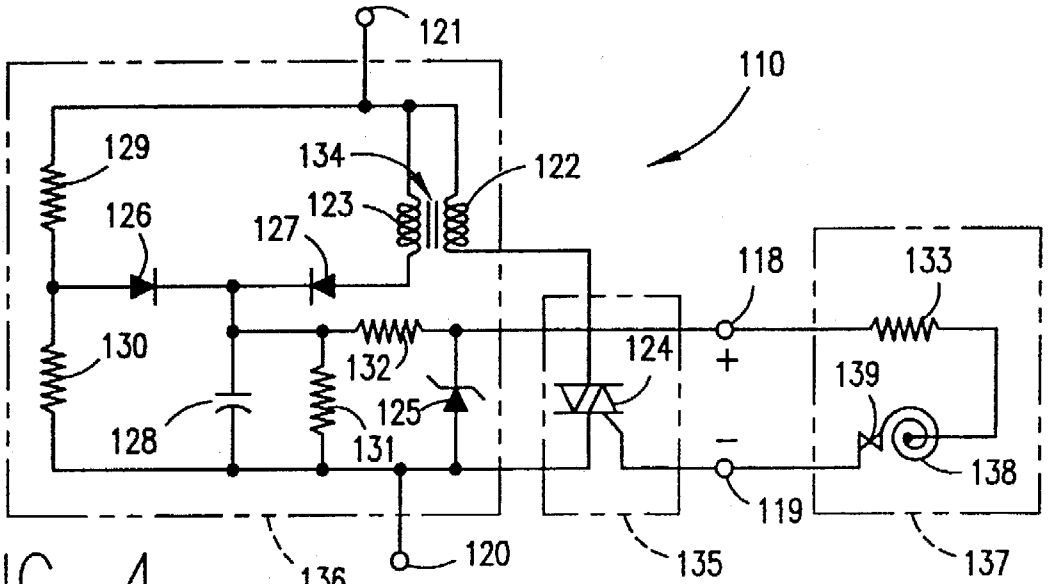
FIG. 4 is a diagram of a circuit to disconnect an electrode when the electrode temperature exceeds a given threshold.

In the event that the horizontal borehole passes through a section of the deposit that has a low resistivity, the electrodes in this section will have lower spreading resistances. This will result in these electrodes capturing more of the applied power, thereby overheating the electrodes. A similar effect may occur if an electrode is located in a section that exhibits a low liquid flow rate. To prevent such an electrode from continuously overheating, the electrical current supplied to the electrode can be turned off in response to an excessive temperature, as by the circuit 110 illustrated in FIG. 4, which may be used in any of the connectors 65 and 68 (FIG. 1) or 74 and 77 (FIG. 2). Circuit 110 contains three major sets of components, a D.C. power supply 136, a semiconductor switch 135, and a switch actuator 137. The switch actuator 137 may use a thermosensitive bimetallic spiral 138 and contacts 139 as shown in FIG. 4, or may be the downhole telemetry receiver shown in FIG. 6. The semiconductor switch 135 of FIG. 4 may be a triac 124 that is turned on or off by the output of the switch actuator 137.

Figure 6:
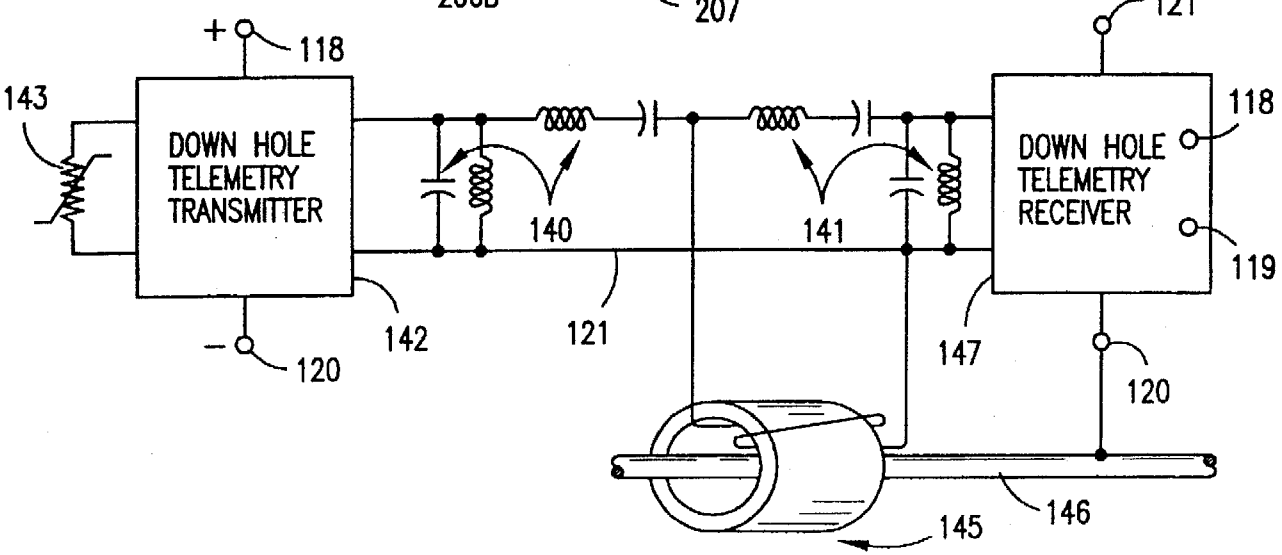
FIG. 6 is a functional block diagram for a downhole telemetry receiver to control the excitation of a selected electrode and the downhole transmitter used to telemeter the status of the temperature near the electrode.

The piggy-back D.C. power supply 136 which extracts power from the power delivery system, supplies D.C. power to the semiconductor switch 135, and as needed to the switch actuator 137 or the telemetry receiver shown in FIG. 6. These three circuit groups 135–137 can be packaged to resist the downhole environment in and around the "T" connectors referred to above. A terminal 120 is connected to the conductor in the "T" section that supplies power to the electrode via a terminal 121 (FIG. 4). The triac 124 serves as a semiconductor switch which is turned off and on by the opening or closing of the temperature sensitive bimetallic spiral 138,139 in actuator 137. When the switch contacts 139 in actuator 137 are closed, turn-on current is injected into the triac, via a resistor 133 from the positive terminal 118 of the power supply 136.

When the temperature exceeds a certain limit, the switch contacts 139 in actuator circuit 137 open, thereby turning the triac 124 off. When the contacts 139 close and the triac 124 is turned on, the principal current flow path from terminal 120 to terminal 121 is via the triac 124 and the primary 122 of a transformer 134. The secondary 123 of the transformer 134 supplies power to the diode rectifier 127. This supplies D.C. voltage to a filter capacitor 128 and to a bleed resistor 131 in parallel with the capacitor. A voltage regulator circuit is formed by a series resistor 132 and a voltage regulating Zener diode 125 that supplies a fixed voltage to the current injection resistor 133.

If the triac 124 is turned off, no current will flow in the transformer primary 122, thereby rendering this section of the D.C. supply circuit 136 ineffective. To assure a D.C. supply when the triac 124 is turned off, an A.C. voltage will appear across terminals 120 and 121. This A.C. voltage is rectified and supplies D.C. current to two resistors 129 and 130 and to a diode 126. Diode 126 supplies current to the filter capacitor 128 and bleed resistor 131. This dual D.C. supply arrangement assures that D.C. power will be available whether the triac 124 is conducting or not conducting.

Other alternatives are available to control the temperature of a specific electrode. For example, the on-off circuit described above (FIG. 4) may be replaced by a more continuous control by varying the duty cycle of the triac in response to a temperature-controlled gate-firing circuit. Alternatively, the triac circuit may be replaced by a mechanical switch activated by metallic alloy "memory metal" that changes shape abruptly when the temperature exceeds a specific threshold.

Figure 5:
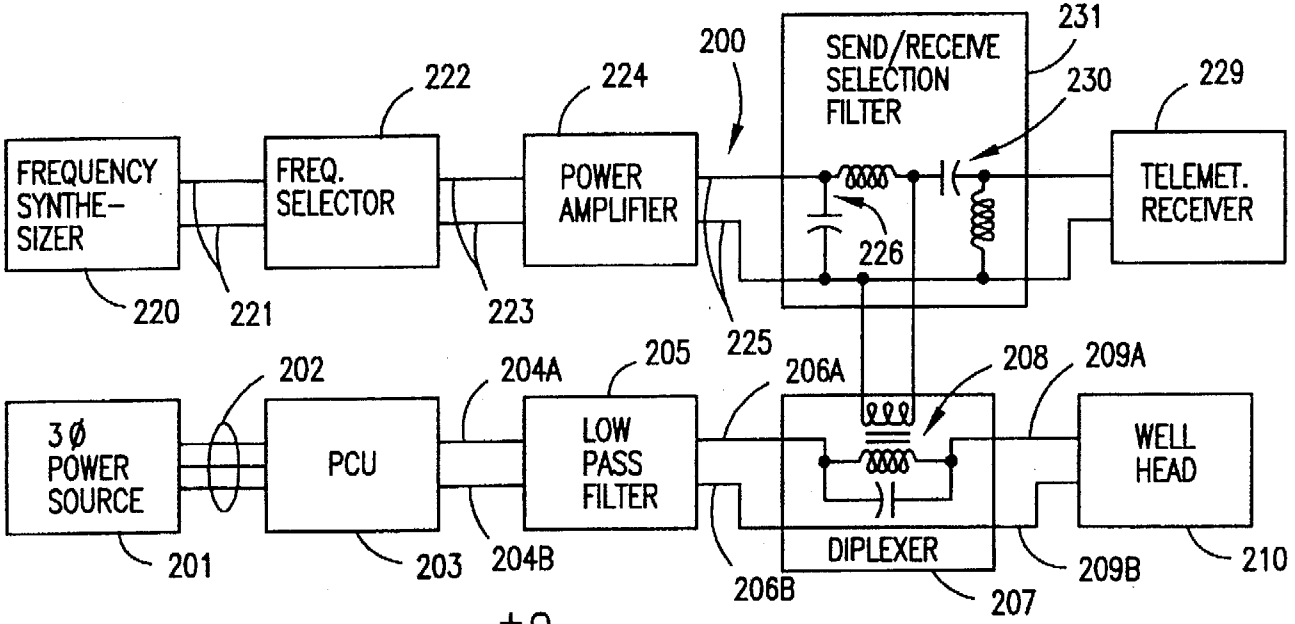
FIG. 5 is a functional block diagram of the surface portion of a telemetering system to control the excitation of one or more selected down-hole heating electrode.

FIGS. 5 and 6 illustrate a telemetry system used to actuate a switching device that connects an electrode to one of the A.C. excited conductors. The actuation can be slow, with on or off conditions lasting hours or minutes to realize a "bang-bang" control wherein the temperature rises to some point and then falls to a lower point during the "off" mode before rising again during the "on" mode. Alternatively, the switch can turn "on" and "off" rapidly with respect to the period of the A.C. power waveform. By varying the "on" time, continuous adjustment of the current flow into the electrode can be realize.

FIGS. 5 and 6 illustrate a carrier frequency or multi-frequency telemetry system. One-way signal sending, from the surface and vice versa, is via the conductors used to deliver power to the heating electrodes. While any group of frequencies can be used, use of frequencies that do not share the same spectral space used by the A.C. power delivery system is preferable to permit operation when the deposit is being heated. One band of frequencies that may be used is above the spectral regions where considerable noise and power frequency harmonics are generated by the power control unit (PCU) for the power source. To eliminate such interference, the output of the power source should be filtered. This is most easily done if the cut-off frequency of the filter is large compared to the frequency of the principal spectral components generated by the PCU or power source. The cut-off frequency may be in the range of three to thirty kHz. This sets the lower limit for the telemetry frequency.

The upper limit of the telemetry frequency range is determined by the attenuation experienced by the telemetered waves as these traverse down or up the well on the power delivery conductors. A study of the propagation loss along typical power delivery conductors suggests that the highest usable frequency could range up to three thousand kHz, with more practical operation up to about one hundred kHz. Thus, more than adequate spectrum space exists to accommodate numerous telemetry channels, especially since the data rates will be small.

While numerous methods of telemetering information exist, the use of single frequency tone bursts will be described. As such, small, frequency-stabilized, narrow bandwidth electro-mechanical resonators, such as quartz-crystal resonators, can be employed to select the desired frequency. Alternatively, the modulation of a single carrier can be varied to provide a unique identifier for each electrode. Other methods, that employ the use of sequences of digitally encoded messages, or time-division multiplex methods, are also possible and can be considered where control of a large number of electrodes is required.

In the case of the simple tone burst method, for example, a 20.0 kHz burst can be transmitted for ten seconds to connect to one electrode. If 22.5 kHz is transmitted for ten seconds, that same electrode would be disconnected. The downhole temperature may be telemetered to the surface by transmitting from a telemetry package mounted near the selected electrode. An FM modulated carrier centered around forty kHz can be used. The frequency of the modulation can be made proportional to temperature, such that a ten Hz modulation would be zero degrees and three hundred Hz would represent one hundred degrees.

FIG. 5 presents a functional block diagram for above-ground telemetry equipment 200. Only the features that are unique to this application of a telemetry system are emphasized. A three-phase 50/60 Hz power line or other power source 201 supplies power to the PCU 203 via insulated cables 202. The PCU [Power Conditioning Unit] converts the three-phase power-frequency, typically to single phase with a frequency in a band of three to six hundred Hz. PCU 203 also tailors the output voltage-current range to the impedance of the electrode(s) and the energy needs for the electrical stimulation process. Via insulated cables 204A and 204B, the output of the PCU is connected to a low pass filter 205 that removes noise and harmonics above a given cut-off frequency, which may be about five kHz. Cables 206A and 206B connect the output of the low-pass filter 205 to a diplexer 207. The diplexer contains a tuned transformer 208 that can insert or withdraw the power within a band of telemeter frequencies, into the energized line 209A from the PCU 203 to the wellhead 210 without affecting the performance of the PCU or power delivery efficiency. Insulated dual conductor cables 209A and 209B apply the combined power from the PCU and telemeter source to the wellhead 210. The dual conductor cable 209A and 209B (cable 42 in FIG. 1) is connected to the feed-through connector 41, and thus to cable 40, as shown in FIG. 1.

A specific band of frequencies are selected to be transmitted downhole; in this example that band is below the frequencies used to telemeter information up from the downhole sensors. Each frequency that is to be transmitted can be derived from a frequency synthesizer 220 (FIG. 5) and transmitted via a coaxial cable 221 to a frequency selector unit 222, in which a specific frequency is selected. Via a coaxial cable 223, the waveform of the selected frequency is applied to a power amplifier 224. The output of the amplifier 224 is applied to a coaxial cable 225 connected to a send/receive frequency selection filter unit 231. Filter unit 231 includes a low pass filter 226 and a high pass filter 230; they allow the output from the power amplifier 224 to be applied to the combiner transformer 20 8 in diplexer 207 without affecting a telemetry receiver 229 that is connected to the send/receive selection filter unit 231. The diplexer 207 will also extract the signals that are telemetered from downhole without overlap from the unfiltered spectral content of waveforms from the PCU 20 3 and apply these signals to the send/receive filter unit 231. Additionally, filter unit 231 allows extraction of the higher frequency signals that are telemetered from downhole sensors from the lower band of control signal waveforms from the amplifier 224.

The applied power from the PCU 203 or the telemetry control signal amplifier 224 flows down the borehole via the dual conductors of cable 40, FIG. 1, and then via the single insulated conductors of cables 64A and 64B (FIG. 1) or via the insulated conductors 70 and 71 of FIGS. 2 and 3. In FIG. 6, the telemetry waveforms from the telemetry amplifier 224 are extracted from the power delivery cable 146 in FIG. 6 by means of a current transformer 145; the cable 146 represents any of the downhole cables referred to above. These signals are applied to a band-pass filter 141 that extracts the control signal waveform from the transformer 145 and applies this waveform to the downhole telemetry receiver 147. At the same time, the filter 141 suppresses any undesired waveform into receiver 147 from the downhole telemetry unit 142. The downhole receiver 147 derives power from the d-c power supply 136 shown in FIG. 1 via terminals 118 and 120(see FIG. 4). Terminal 120is connected to one of the dual conductors, such as conductor 146. The extracted telemetry signals from the surface are applied to the downhole telemetry receiver 147 via the filter 141.

When a heating electrode is to be controlled from the surface, the thermal control 137 shown in FIG. 4 is not used. Instead, on/off control signals from the telemetry receiver 147, FIG. 6, are applied to terminals 118 and 119 of the d-c power supply 136 (FIG. 4) to supply a "gate on" firing signal to the triac 124. When one frequency of the telemeter signal is received, the state of a latching circuit in downhole receiver 147, FIG. 6, is set so as to provide turn-on injection current for the triac, as if the switch 139 in the temperature sensor package 137 (FIG. 4) were closed. If another frequency is received, the latching circuit in the receiver 147 can be set such that the triac firing current will be terminated, thereby causing the electrode to be effectively disconnected from cable 146. Direct current power is supplied to the telemetry receiver 147 by terminals 118, 120from the D.C. power supply 136 (FIG. 4).

By the use of additional control frequencies, the firing of the triac 124 can be delayed by discrete intervals with respect to the turn-off current that occurs when the phase of the current through the triac is reversed. This delays application of current to the heating electrode and allows variation in the power dissipated in the deposit near that electrode. This is readily accomplished by known latching circuits (not shown) whose state is determined upon receipt of one or more of the additional frequencies. The state of the latching circuits determines the delay of the firing function. Such delay circuits are well known and any of a number of digital timing methods or monostable time delay circuits can be used for this purpose.

FIG. 6 also shows the downhole telemetry transmitter unit 142, which comprises a thermo-sensitive sensor 143, such as a thermistor. A connection is made, in unit 142, to the terminals 120and 118 of the power supply 136; see FIG. 4. The output of the downhole telemetry transmitter 142 (FIG. 6) is applied to a band-pass filter 140. Filter 140 provides a pass band for the output frequencies of the transmitter 142, while filter 141 prevents entry of these transmitted frequencies into the down hole telemetry receiver 147. The output of the filter 140 is applied to the current transformer 145 such that the power delivery cable 146 is excited to propagate the telemetry signal up to the above-ground receiver.

Figure 7:
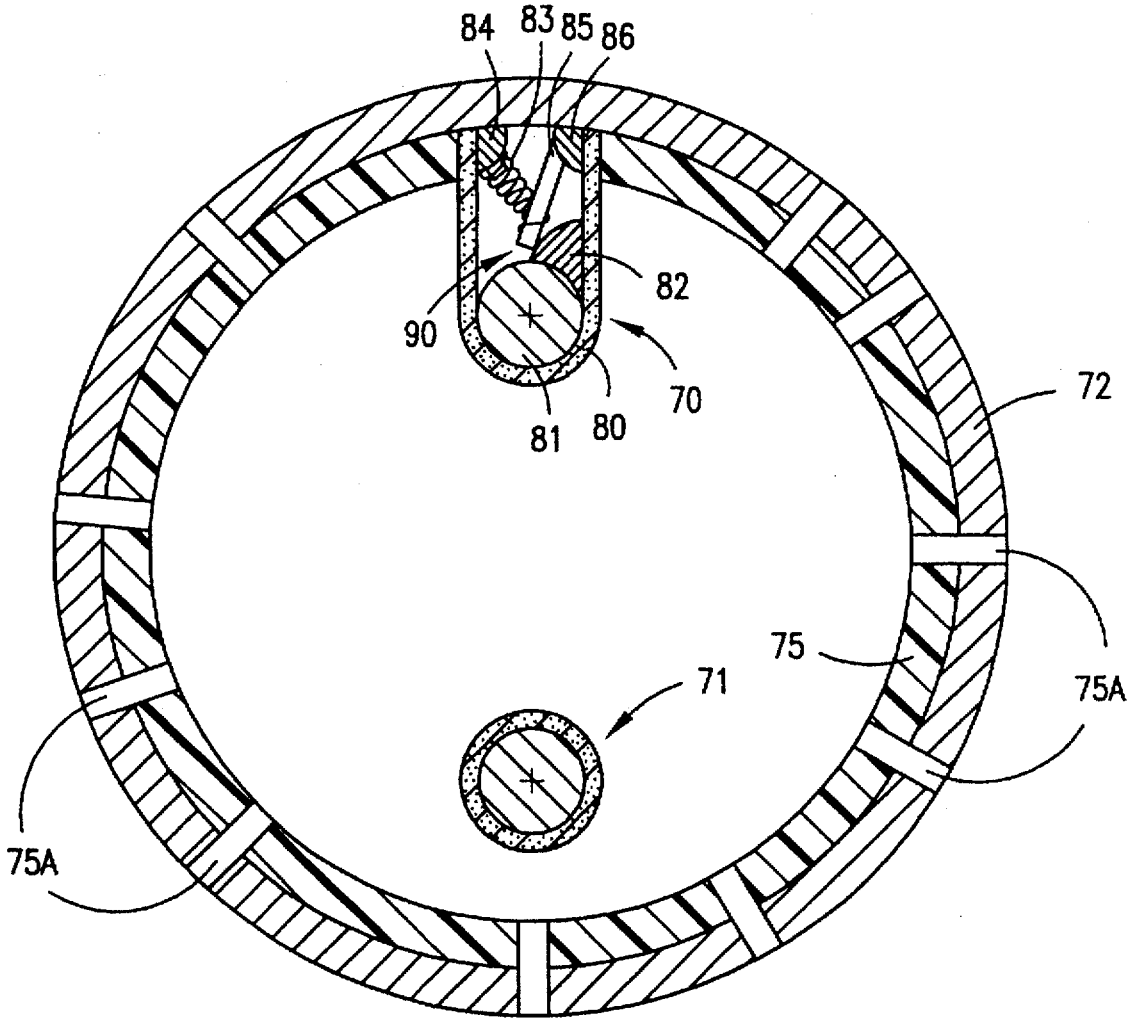
FIG. 7 is a further enlarged sectional view, similar to FIG. 3, showing passive control of the temperature of a heating electrode by means of a shaped memory alloy or shaped memory composite.

FIG. 7 presents a cable cross-section, like that shown in FIG. 3 except that a shaped memory metal or composite is employed to actuate a switch that connects a power delivery conductor to an electrode. The shaped memory metal (or composite), when deformed plastically in its low temperature state, has the property of returning to its original shape when heated above its transition temperature. Such materials are available commercially.

In FIG. 7, the heating electrode 72 is connected to the positive phased conductor 81 via a memory metal actuated switch assembly 90. The positive phased conductor 81 and the memory metal switch assembly 90 are covered with electrical insulation 80. Shown below the positive phased insulated conductor 70 is the oppositely phased cable 71, which includes an insulating sheath and a copper or aluminum conductor.

The heating electrode 72 surrounds a fiber reinforced plastic pipe (FRP) 75; other insulator pipe can be used. Both the electrode 72 and the FRP 75 are penetrated by slots or perforations 75A. A shaped composite metal nickel-titanium alloy spiral spring 83 is mechanically connected to a copper metal base section 84 and to a copper metal spring alloy bar 85 that is electrically embedded in a metallic base plate 86 that is connected to the electrode 72. The normal compressed shape of the spring 83 is plastically expanded at low temperature such that the bar 85 will be forced against the contact 82. When the temperature of the electrode substantially exceeds the transition temperature of the nickel-titanium alloy spring 83, the spring 83 will revert to its original compressed shape, thereby pulling bar 85 away from contact 82.

While the foregoing techniques have been described in the context of a long horizontal completion, there are some vertical well installations that may require the use of a similar iterated electrode system. Such wells usually exhibit high unstimulated flow rates and lengths in excess of ten meters. The spacing of the heating electrodes is also governed according to the vertical resistivity profile of the well, with the heating electrodes placed in regions of high resistivity, large oil saturation, and fluid permeability. Regions of low resistivity should be avoided, as well as regions of low oil saturation and/or fluid permeability.

This invention is not limited as to the precise nature of the telemetry communication pathway. Armored cables that deliver power downhole to pump motors often contain small diameter wires embedded in insulation. These wires, or additional wires, can be dedicated to supply power to the downhole sensors and telemetry units and may also serve as a telemetry communication pathway. Such wires can also be used as a telemetry pathway only wherein the power to the downholes electronic circuits of the sensors, switches and telemetry apparatus is supplied from the power delivery system. Other communication means are possible via fiber-optic cables; the control or sensor signals can be telemetered or transmitted via the fiber-optic cable. In the case of fiber-optic cables used for telemetry, the energy to operate the downhole sensor and telemetry circuits may be derived from the power delivery system that supplies energy to the heating electrodes.

In the case of horizontal wells, the assumption that the deposit is precisely horizontally layered may not apply. Therefore the heating electrode considerations just noted for a vertical well also apply for quasi-horizontal wells.

The invention is not limited as to the precise nature of the power delivery system or to the features of the power supply or PCU. For example, the dual conductor pair need not be in the form of a cable, but rather could be a combination of an insulated tubing and the production casing. These could be used to excite a downhole transformer that is located near the horizontal section. The secondary of such a transformer provides the positive phase excitation and the negative phase excitation of the dual conductor delivery system within the horizontal screen section. Rather than use a dual conductor cable, such as cable 40 in FIG. 1, a three conductor cable could be used that is excited by a power source that has a three phase output. In this case, the screen would enclose three insulated conductors that would excite sequences of three electrodes, wherein the phase difference between the excitation of adjacent electrodes would be approximately 120°.

In addition, parameters other than temperature can be sensed. These might include the resistivity of the liquids or the pressures within different portions of the horizontal borehole, as well as electrical parameters such as the current or the open circuit voltage to one or more electrodes.

I claim:

1. An electrical control for an iterated heating electrode array for an oil well, the oil well comprising an initial well bore extending downwardly from the surface of the earth through overburden formations and a producing well bore in communication with and extending from the initial well bore into an oil producing formation, the electrode array including sets of two or more electrically isolated conductive heating electrodes spaced longitudinally through the producing well bore, and a plural-conductor energizing cable for electrically energizing the heating electrodes in each set of electrodes with A.C. power at a phase displacement of at least 90°, the electrical control comprising:

a plurality of sensor switches, each sensor switch being connected from the energizing cable to one heating electrode, each sensor switch being actuated only for a predetermined sensing range and being unactuated above that range.

2. An electrical control for an iterated heating electrode array for an oil well according to claim 1 in which each sensor switch is a temperature sensor and in which the sensing range is a predetermined temperature range.

3. An electrical control for an interated heating electrode array for an oil well according to claim 2 in which each sensor switch includes a thermally distortable electrically conductive spring, conductively connected to its associated heating electrode.

4. An electrical control for an iterated heating electrode array for an oil well, according to claim 1, in which the control further comprises:

a plurality of power switches, each power switch connecting its associated heating electrode to the energizing cable; and a telemeter system coupled through a telemetry pathway to each of the sensor switches and coupled to each of the power switches to actuate each power switch in accordance with the operating condition of the associated sensor.

5. An electrical control for an iterated heating electrode array for an oil well, the oil well comprising an initial well bore extending downwardly from the surface of the earth through overburden formations and a producing well bore in communication with and extending from the initial well bore into an oil producing formation, the electrode array including a plurality of electrically isolated conductive heating electrodes spaced longitudinally through the producing well bore, and a plural-conductor energizing cable for electrically energizing the heating electrodes in each set of electrodes with A.C. power at a phase displacement of at least 90°, the electrical control comprising:

a plurality of telemeter sensors, one for each controllable heating electrode and all coupled to a telemetry communication pathway, for generating telemeter data signals indicative of a parameter representative of the operating condition of a controllable heating electrode, which telemeter data signals are transmitted to the surface via the telemetry communication pathway;

a surface telemeter apparatus, coupled to the telemetry communication pathway, for receiving the telemeter data signals and for generating telemeter actuation signals based on the telemeter data signals, which telemeter actuation signals are transmitted down hole via the telemetry communication pathway;

a plurality of signal-actuated power switches, each connecting one controllable heating electrode to a conductor of the energizing cable to electrically energize the heating electrode; and a plurality of telemeter channels, one for each controllable heating electrode;

all heating electrodes being coupled to the energizing cable, each connected to one power switch to apply actuation signals to the associated power switch, the actuation signal being representative of the telemeter actuation signals.

6. An electrical control for an iterated heating electrode array for an oil well, the oil well comprising an initial well bore extending downwardly from the surface of the earth through overburden formations and a producing well bore in communication with and extending from the initial well bore into an oil producing formation, the electrode array including a plurality of electrically isolated conductive heating electrodes spaced longitudinally through the producing well bore, and a plural-conductor energizing cable for electrically energizing the heating electrodes in each set of electrodes with A.C. power at a phase displacement of at least 90°, the electrical control comprising:

a plurality of telemeter sensors, one for each controllable heating electrode and all coupled to a telemetry communication pathway, for generating telemeter data signals indicative of a parameter representative of the operating condition of a controllable heating electrode, which telemeter data signals are transmitted to the surface via the telemetry communication pathway;

a surface telemeter apparatus, coupled to the telemetry communication pathway, for receiving the telemeter data signals and for generating telemeter actuation signals based on the telemeter data signals, which telemeter actuation signals are transmitted down hole via the telemetry communication pathway;

a plurality of signal-actuated power switches, each connecting one controllable heating electrode to a conductor of the energizing cable to electrically energize the heating electrode; and a plurality of telemeter channels, one for each controllable heating electrode;

all heating electrodes being coupled to the energizing cable, each connected to one power switch to apply actuation signals to the associated power switch, the actuation signal being representative of the telemeter actuation signals;

power for the downhole telemetry receivers and transmitters being supplied from the energizing cable.

7. An electrical control for an iterated heating electrode array for an oil well, according to claim 1, in which the control further comprises:

a plurality of power switches, one for each heating electrode, each power switch connecting its associated heating electrode to the energizing cable; and a telemeter system coupled through the energizing cable to each of the sensor switches and coupled to each of the power switches to actuate each power switch in accordance with the operating condition of the associated sensor switch.

8. An electrical control for an iterated heating electrode array for an oil well, the oil well comprising an initial well bore extending downwardly from the surface of the earth through overburden formations and a producing well bore in communication with and extending from the initial well bore into an oil producing formation, the electrode array including a plurality of electrically isolated conductive heating electrodes spaced longitudinally through the producing well bore, and a plural-conductor energizing cable for electrically energizing the heating electrodes in each set of electrodes with A.C. power at a phase displacement of at least 90°, the electrical control comprising:

a plurality of telemeter sensors, one for each heating electrode and all coupled to the energizing cable, for generating telemeter data signals indicative of a parameter representative of the operating condition of one heating electrode, which telemeter data signals are transmitted to the surface via the energizing cable;

a surface telemeter apparatus, coupled to the energizing cable, for receiving the telemeter data signals and for generating telemeter actuation signals based on the telemeter data signals, which telemeter actuation signals are transmitted down hole via the energizing cable;

a plurality of signal-actuated power switches, each connecting one heating electrode to a conductor of the energizing cable to electrically energize the heating electrode; and a plurality of telemeter channels, one for each heating electrode and all coupled to the energizing cable, each connected to one power switch to apply actuation signals to the associated power switch, the actuation signal being representative of the telemeter actuation signals.

9. An electrical control for an iterated heating electrode array for an oil well according to claim 8, in which the telemeter signals are all in frequency ranges different from the A.C. power frequency, and in which the telemeter data signals are in a first frequency range different from a second frequency range encompassing the telemeter actuation signals.

10. An electrical control for an iterated heating electrode array for an oil well according to claim 8, in which each sensor is a sensor switch that includes a thermally distortable electrically conductive spring, conductively connected to its associated heating electrode.

* * * * *